US007079792B2

(12) United States Patent
Yoshino

(10) Patent No.: US 7,079,792 B2
(45) Date of Patent: Jul. 18, 2006

(54) DEVELOPING UNIT USING A DEVELOPING LIQUID AND IMAGE FORMING APPARATUS INCLUDING THE SAME

(75) Inventor: Mie Yoshino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/130,111

(22) Filed: May 17, 2005

(65) Prior Publication Data

US 2005/0207791 A1 Sep. 22, 2005

Related U.S. Application Data

(63) Continuation of application No. 10/679,489, filed on Oct. 7, 2003, now Pat. No. 6,904,254, which is a continuation of application No. 09/754,061, filed on Jan. 5, 2001, now Pat. No. 6,636,716.

(30) Foreign Application Priority Data

Jan. 11, 2000 (JP) ..... 2000-002147

(51) Int. Cl.
*G03G 15/10* (2006.01)

(52) U.S. Cl. ..... 399/240

(58) Field of Classification Search ..... 399/107, 399/119, 222, 237, 238, 239, 240
See application file for complete search history.

(56) References Cited

U.S. PATENT DOCUMENTS

| | | | | |
|---|---|---|---|---|
| 4,327,664 | A * | 5/1982 | Ohkawa et al. | 399/240 |
| 5,574,548 | A | 11/1996 | Iino et al. | |
| 5,826,148 | A | 10/1998 | Iino et al. | |
| 6,072,972 | A * | 6/2000 | Obu et al. | 399/237 |
| 6,104,901 | A | 8/2000 | Imamiya | |
| 6,226,468 | B1 * | 5/2001 | Tsukamoto et al. | 399/57 |
| 6,311,034 | B1 | 10/2001 | Nakashima et al. | |
| 6,314,253 | B1 | 11/2001 | Hosoya et al. | |

* cited by examiner

*Primary Examiner*—Hoan Tran
(74) *Attorney, Agent, or Firm*—Oblon, Spivak, McClelland, Maier & Neustadt, P.C.

(57) ABSTRACT

A developing unit includes a developing roller including a roller portion. The developing roller is rotatable while carrying a developing liquid on the roller portion. The developing unit also includes a voltage applying device that applies a voltage to the roller portion to form an electric field for development between the roller portion and an image carrier, whereby the developing liquid deposited on the roller portion is transferred to a latent image formed on the image carrier. The roller portion includes a volume resistivity ranging from 0 Ω·cm to $10^7$ Ω·cm.

11 Claims, 3 Drawing Sheets

DEVELOPING UNIT USING A DEVELOPING LIQUID AND IMAGE FORMING APPARATUS INCLUDING THE SAME

CROSS-REFERENCE TO RELATED APPLICATIONS

This application is a continuation of U.S. application Ser. No. 10/679,489, filed Oct. 7, 2003, now U.S. Pat. No. 6,904,254 which is a continuation of U.S. application Ser. No. 09/754,061, filed Jan. 5, 2001, now Pat. No. 6,636,716, and is based upon and claims the benefit of priority from the prior Japanese Patent Application No. 2000-002147, filed Jan. 11, 2000, the entire contents of each of which are incorporated herein by reference.

BACKGROUND OF THE INVENTION

The present invention relates to a developing unit of the type developing a latent image formed on an image carrier by depositing a developing liquid, which consists of a carrier liquid and a developing substance, and a copier, facsimile apparatus, printer or similar image forming apparatus including the same.

A developing unit for use in an image forming apparatus uses either one of a dry powdery developer or a developing liquid. Generally, a developing unit using a developing liquid includes a developing roller rotatable while carrying the liquid thereon. A voltage for development is applied to the developing roller to thereby form an electric field between the roller and an image carrier.

The problem with a developing unit of the type described is that a toner image formed thereby is sometimes irregular. By a series of researches and experiments, I found that irregular development was ascribable to the unstable strength of the electric field. Further, I found that in a so-called contact type developing unit that develops the latent image with the developing roller contacting the image carrier, irregularities on the surface of the roller cause fine irregularities to appear on the surface of the developing liquid deposited on the roller, also making development irregular.

SUMMARY OF THE INVENTION

It is therefore an object of the present invention to provide a developing unit using a developing liquid and capable of reducing irregular development, and an image forming apparatus including the same.

In accordance with the present invention, a developing unit for developing a latent image formed on an image carrier with a developing liquid consisting of a carrier liquid and a developing substance includes a developing roller including a roller portion and configured to rotate while carrying the developing liquid on the roller portion. A voltage applying device applies a voltage to the roller portion to thereby form an electric field for development between the roller portion and the image carrier. The electric field transfers the developing liquid deposited on the roller portion to a latent image formed on the image carrier. The roller portion has a volume resistivity ranging from 0 Ω·cm to $10^7$ Ω·cm.

Further, in accordance with the present invention, an image forming apparatus includes an image carrier configured to carry a latent image thereon. A developing unit develops the latent image by depositing a developing liquid, which consists of a carrier liquid and a developing substance, on the latent image. A developing roller includes a roller portion and rotates while carrying the developing liquid on the roller portion. A voltage applying device applies a voltage to the roller portion to thereby form an electric field for development between the roller portion and the image carrier. The electric field transfers the developing liquid from the roller portion to the latent image formed on the image carrier. The roller portion has a volume resistivity ranging from 0 Ω·cm to $10^7$ Ω·cm.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
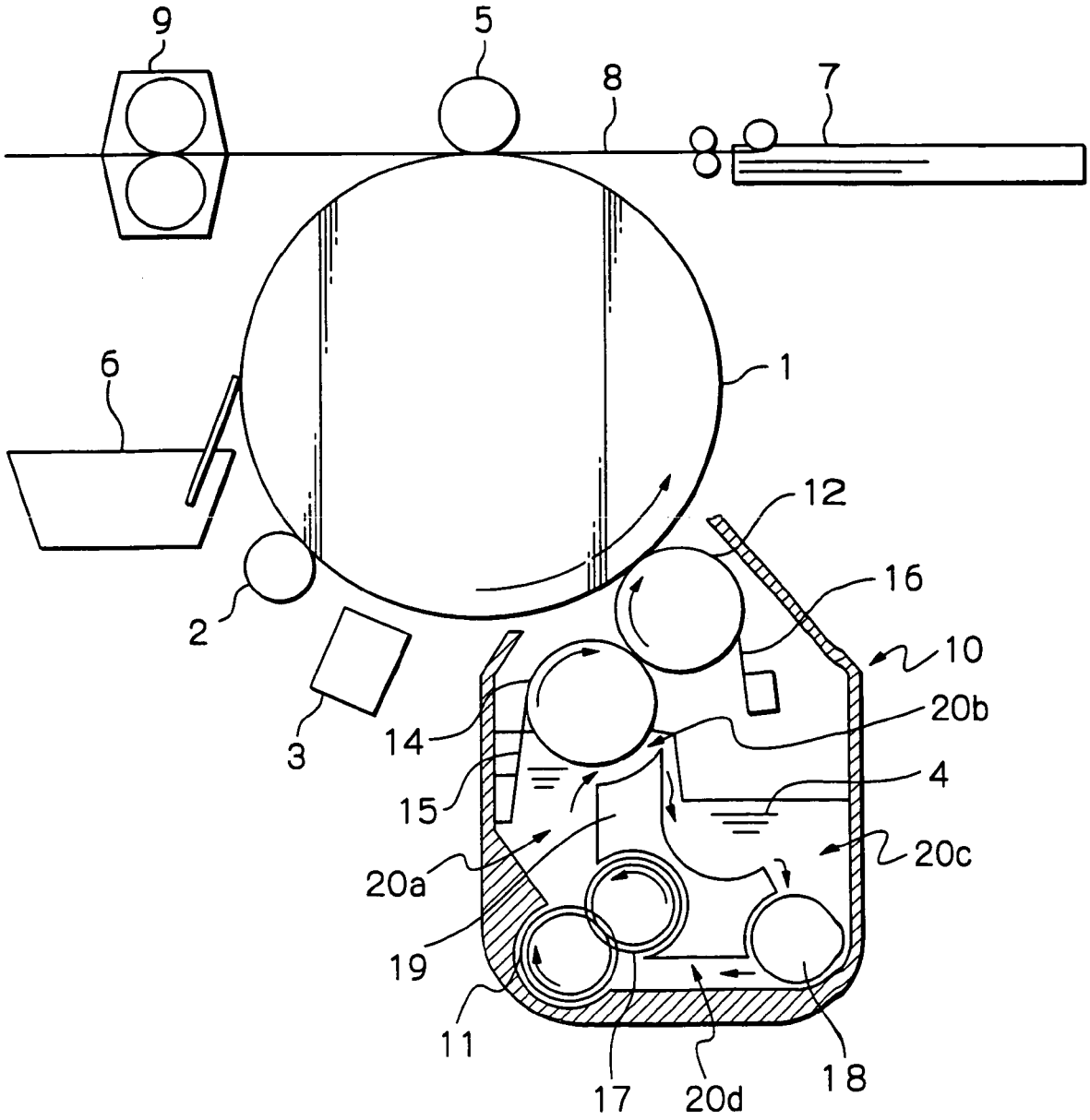
FIG. 1 is a view showing an image forming apparatus embodying the present invention.

Referring to FIG. 1 of the drawings, an image forming apparatus embodying the present invention is shown and implemented as an electrophotographic printer by way of example. As shown, the printer includes a photoconductive drum 1 that is a specific form of an image carrier. A charge roller 2, an exposing unit 3, a developing unit 10, an image transferring device 5 and a cleaning unit 6 are arranged around the drum 1. A paper feeding device 7 and a fixing unit 9 are respectively located at the right-hand side and left-hand side of the image transferring device, as viewed in FIG. 1.

While the drum 1 is rotated counterclockwise, as viewed in FIG. 1, the charge roller 2 uniformly charges the surface of the drum 1. The exposing unit 3 optically scans the charged surface of the drum 1 in accordance with image data to thereby form a latent image thereon. The developing unit 10 develops the latent image with toner, which is a developing substance contained in a developing liquid 4, for thereby forming a corresponding toner image.

The developing liquid 4 consists of a carrier liquid and toner densely dispersed in the carrier liquid. The carrier liquid may be implemented by dimethyl polysiloxane oil or similar insulative liquid. The developing liquid 4 has viscosity as high as 100 to 10,000 Pa.s.

A paper sheet 8 is fed from the paper feeding device 7 to the image transferring device 5 at a preselected timing. The image transferring device 5 transfers the toner image from the drum 1 to the paper sheet 8. The paper sheet 8 carrying the toner image thereon is conveyed to the fixing unit 9. The fixing unit 9 fixes the toner image on the paper sheet 8 with heat and pressure. The cleaning unit 6 mechanically scrapes off the developing liquid 4 left on the drum 1 after the image transfer.

The procedure described above is repeated to form toner images on consecutive paper sheets 8 sequentially fed from the paper feeding device 7.

The developing unit 10 includes a reservoir 11 storing the developing liquid 4. The reservoir 11 accommodates therein a developing roller or developer carrier 12, an applying roller 14, a metering blade 15, a collecting blade 16, a circulation pump 17, and a screw or agitator 18. The metering blade regulates the thickness of the developing liquid 4 applied to the developing roller 12 by the applying roller 14. The collecting blade 16 collects the developing liquid 4 left on the developing roller 12. The circulation pump 17 circulates the developing liquid 4 in the reservoir 11 while the screw 18 agitates the liquid 4.

A partition 19 is positioned at the center of the reservoir 11 and extends in the axial direction of the applying roller 14. The partition 19 causes the developing liquid 4 to be circulated. Specifically, the partition 19 divides the reservoir 11 into a feeding portion 20*a* for feeding the developing liquid 4 to the applying roller 14 and a collecting portion 20*c* for collecting the liquid 4 left on the developing roller 12. The feeding portion 20*a* and collecting portion 20*c* are communicated to each other via a communicating portion 20*d*, which is formed below the partition 19. The developing liquid 4 removed from the applying roller 14 is recirculated to the collecting portion 20*c* via a recirculating portion 20*b*, which is formed above the partition 19. In this manner, a circulation path is formed between the inner periphery of the reservoir 11 and the partition 19.

The circulation pump 17 is positioned at the boundary between the feeding portion 20*a* and the communicating portion 20*d*. The circulation pump 17 is implemented by a gear pump operatively connected to an electric motor not shown. Alternatively, use may be made of the combination of a one-way valve and a piston so long as it can cause the developing liquid 4 to flow along the above-described circulation path. The circulation pump 17 circulates the developing liquid 4 via the feeding portion 20*a*, recirculating portion 20*b*, collecting portion 20*c* and communicating portion 20*d* in this order.

The applying roller 14 is positioned in the upper part of the feeding portion 20*a* and rotatable clockwise, as viewed in FIG. 1, for scooping up the developing liquid 4. The metering blade 15 uniforms the thickness of the developing liquid 4 carried on the applying roller 14. The applying roller 14 applies the developing liquid 4 to the developing roller 12.

A driving device, not shown, rotates the screw or agitator 18 clockwise, as viewed in FIG. 1. The screw 18, intervening between the collecting portion 20*c* and the communicating portion 20*d*, delivers the developing liquid from the collecting portion 20*c* to the communicating portion 20*d* while agitating it.

A hole, not shown, is formed in the collecting portion 20*c* for replenishing the developing liquid 4, toner and carrier liquid into the reservoir 11.

A driving device, not shown, rotates the developing roller 12 clockwise, as viewed in FIG. 1. The developing roller 12 partly protrudes from the reservoir 11 via an opening formed in the reservoir 11 and contacts the drum 1 to thereby form a nip. The developing roller 12 moves in the same direction as the drum 1, as seen at the nip. The developing liquid 4, forming a thin layer on the developing roller 12, is nipped between the developing roller 12 and the drum 1.

A power source or a voltage applying device, not shown, is connected to the developing roller 12 so as to apply a bias for development to the developing roller 12. The bias forms an electric field for development at the nip between the developing roller 12 and the drum 1. The electric field exerts an electrostatic force on the toner contained in the thin liquid layer, which is passing through the nip in accordance with the rotation of the drum 1. As a result, the toner is transferred from the developing roller 12 to the drum 1, developing the latent image formed on the drum 1. At the same time, the electric field causes the toner not facing the latent image to return to the surface of the developing roller 12. This prevents the toner from depositing on the non-image area of the drum 1 while allowing only a small amount of carrier liquid to deposit on the above area of the drum 1.

The collecting blade 16 is positioned in the upper part of the collecting portion 20*c*. The collecting blade 16 scrapes off the thin liquid layer left on the surface of the developing roller 12 that has moved away from the nip between the developing roller 12 and the drum 1. The developing liquid 4 collected by the blade 16 is returned to the collecting portion 20*c*.

Figure 2:
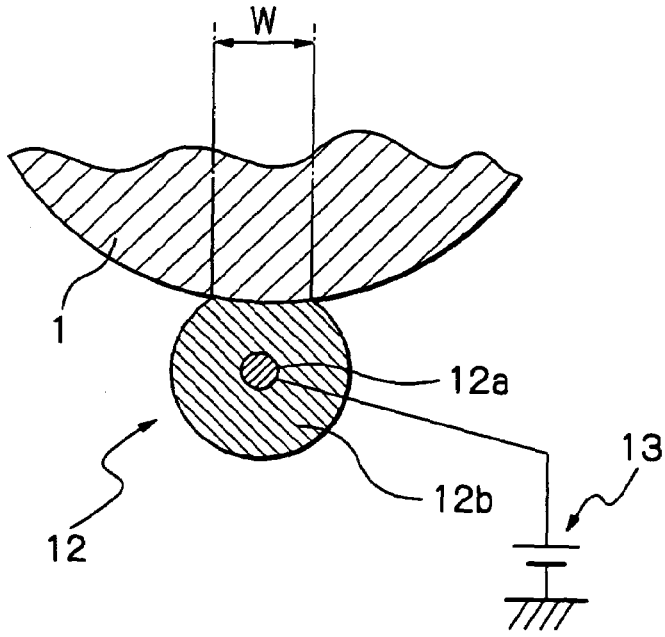
FIG. 2 is a fragmentary section showing a photoconductive drum and a developing roller included in the illustrative embodiment.

Configurations unique to the illustrative embodiment will be described with reference to FIG. 2. As shown, the developing roller 12 is made up of a core or shaft 12*a* formed of metal or similar conductive material and a roller 12*b* formed of silicone rubber, urethane rubber or similar elastic material. A power source 13 is connected to the core 12*a* in order to apply the previously mentioned bias to the core 12*a*. The drum 1 and roller 12*b* are pressed against each other by a preselected pressure, forming a nip having a width W.

As for the roller 12*b*, carbon black or similar conductive substance is dispersed in the elastic material to implement a volume resistivity of 0 Ω·cm to $10^7$ Ω·cm. When the bias is applied from the power source 13 to the core 12*a*, the surface potential of the roller 12*b* becomes substantially equal to the bias. As soon as the surface potential of the roller 12*b* is stabilized, it stabilizes the strength of the electric field formed between the roller 12*b* and the drum 1. This successfully obviates irregular development ascribable to the unstable strength of the electric field. A series of experiments showed that when the volume resistivity of the roller 12 was $10^8$ Ω·cm or above, the surface potential of the roller 12*b* was sometimes lower than the bias for development due to voltage drop. As a result, the strength of the electric field fluctuated in accordance with the rotation of the roller 12*b* and rendered development irregular.

Figure 3:
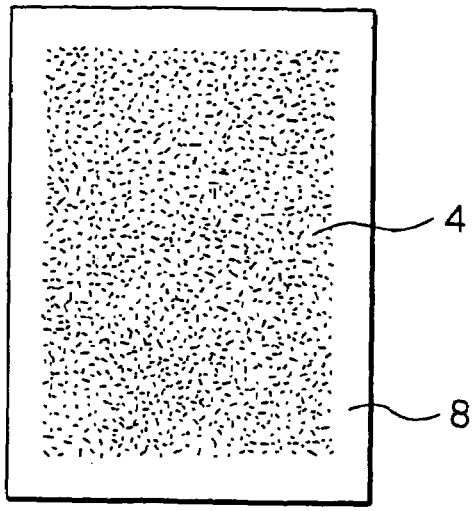
FIG. 3 is a sketch of a solid image achievable when a roller portion forming part of the developing roller has a ten-point mean surface roughness of 3 μm or less.

The roller 12*b* is produced by, e.g., extrusion molding and provided with a ten-point mean surface roughness of 3 μm or less. The roller 12*b* with such a surface roughness causes a minimum of fine irregularity to appear on the surface of the liquid layer carried thereon, thereby reducing irregular development. It was experimentally found that by so reducing irregular development, a smooth solid image shown in FIG. 3 was achieved. When the ten-point surface roughness of the roller 12*b* was 4 μm or above, fine irregularity sometimes appeared on the surface of the thin liquid layer. For example, when the liquid layer on the roller 12*b* was 3 μm to 10 μm thick, the surface level of the thin liquid layer sometimes subtly waved due to the influence of the surface configuration of the roller 12*b*, resulting in fine irregularity and therefore irregular development.

Figure 4:
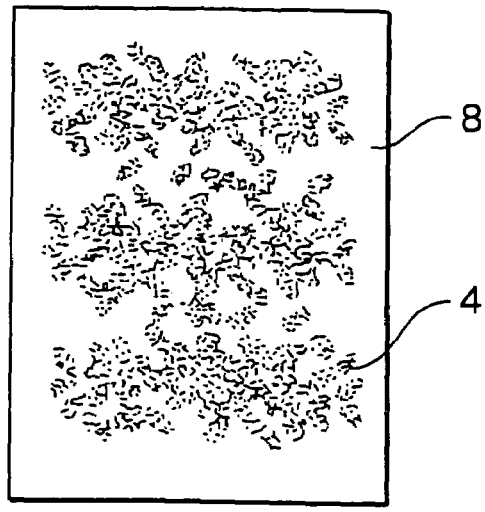
FIG. 4 is a sketch of a solid image formed when the roller portion has a ten-point mean surface roughness of 4 μm or above.

Assume that the roller 12*b* is formed of a foam material in order to exhibit desired elasticity. Then, the cellular structure of the foam material makes the contact pressure (nip pressure hereinafter) between the drum 1 and the roller 12*b* irregular. The developing liquid 4 forced out of the portions where the nip pressure is high enters the portions where the nip pressure is low, resulting in the irregular thickness of the thin liquid layer. The irregular thickness is also brought about by the fact that the developing liquid 4 enters the portions where the inside of the cellular structure is exposed, but does not enter the other portions where it is not exposed. Such irregularities in thickness make the distance between the surface of the drum 1 and the elastic roller 12*b* non-uniform and thereby render the electrostatic force acting on the toner unstable. More specifically, the electrostatic force is weaker at portions where the above distance is long than at portions where it is short. FIG. 4 shows a specific solid image rendered rough by the unstable electrostatic force. The roller 12*b* should therefore preferably be formed of an elastic material other than foam materials.

The toner does not instantaneously migrate to the roller 12*b* or the drum 1 at the nip, but needs a certain period of time to do so. This period of time is noticeably effected by the viscosity of the developing liquid 4. To insure high-quality images, it is necessary to guarantee a sufficient period of time T for the toner to pass through the nip and surely migrate at the nip. The period of time T is expressed as:

$$T(\text{sec})=W(\text{mm})/V(\text{mm/sec})$$

where W denotes a nip width, and V denotes a process speed, i.e., the linear velocity of the drum 1 and developing roller 12.

As the above equation indicates, a decrease in the process speed V translates into an increase in the period of time T, but undesirably lowers the printing speed. It is therefore desirable to extend the period of time T by increasing the nip width W. However, if the nip pressure is excessively increased to increase the nip width W, it is likely that the roller 12*b* permanently deforms. It follows that the hardness of the roller 12*b* should preferably be 30° or below in JIS-A scale or 60° or below in Asker-C hardness.

Figure 5:
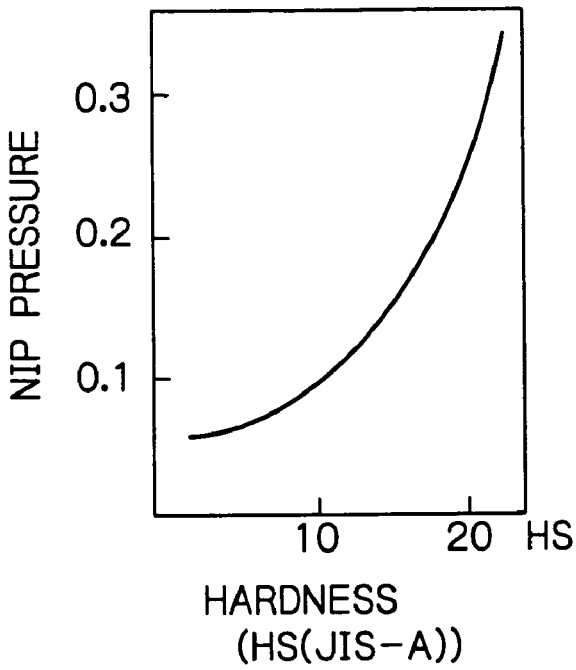
FIG. 5 is a graph showing a relation between a nip pressure and the hardness of the roller portion for a given nip width of the roller portion.

FIG. 5 shows a relation between the nip pressure and the hardness of the roller 12*b* with respect to a given nip width W. As FIG. 5 indicates, for a given nip width W, the required nip pressure decreases with a decrease in the JIS-A hardness of the roller 12*b*. Assume that the acceleration of gravity is N. Then, if the nip pressure is reduced to 0.3 $N/m^2$ or less, its influence on the drum 1, developing roller 12 and drivelines for driving them is presumably negligible in practice, so that the permanent deformation of the roller 12*b* is suppressed.

Figure 6:
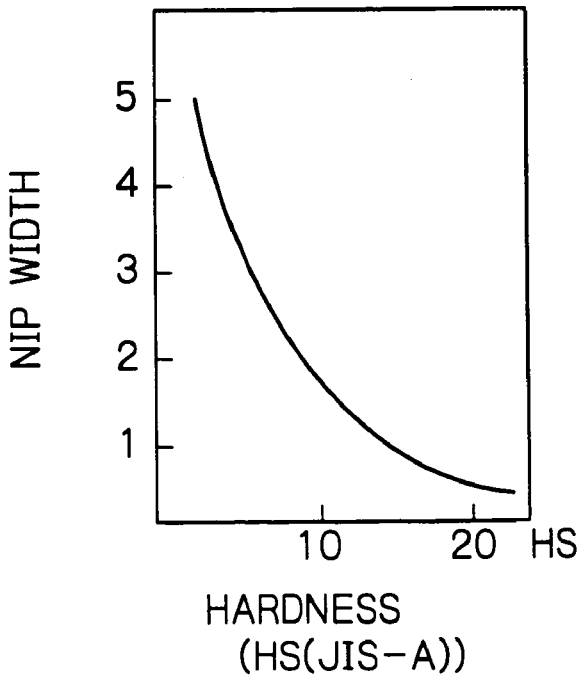
FIG. 6 is a graph showing a relation between the nip width W and the hardness (JIS (Japanese Industrial Standards) A scale) of the roller portion for a given nip pressure.

FIG. 6 is a graph showing a relation between the nip width W and the hardness of the roller 12*b* with respect to a given nip pressure. As shown, for a given nip pressure, the required nip width W decreases with a decrease in the hardness of the roller 12*b*. Also, when the hardness of the roller 12*b* exceeds 30° in JIS-A scale, the rate of variation of the nip width W sharply decreases. It is to be noted that JIS-A hardness and Asker-C hardness have some degree of correlation; 30° in JIS-A scale substantially corresponds to 60° in Asker-C scale. In practice, it is extremely difficult to produce an elastic body whose JIS-A hardness is less than 3°. It is therefore desirable to provide the roller 12*b* with a hardness of 3° to 30° in JIS-A scale or a corresponding hardness in Asker-C scale. Further, it is desirable to uniform the hardness in the axial and circumferential directions of the roller shaft. This is successful to surely uniform the nip pressure and therefore the thickness of the liquid layer.

The surface of the drum 1 should preferably be formed of a-Si so as to be protected from damage ascribable to contact with the roller 12*b* and from deterioration ascribable to water absorption and swelling.

In summary, it will be seen that the present invention provides a developing unit and an image forming apparatus using the same having various unprecedented advantages, as enumerated below.

(1) Irregular development ascribable to the unstable strength of an electric field for development is obviated, so that irregular development is reduced.

(2) Irregular development ascribable to fine irregularities on the surface of a developing liquid, which is carried on a roller, is reduced to, in turn, reduce irregular development.

(3) A nip width great enough for a developing substance to surely migrate from the roller to a latent image formed on an image carrier is guaranteed. This can be done without increasing the diameter of the roller or pressing the roller against the image carrier by a pressure that would cause the roller to permanently deform.

(4) The surface of the image carrier is protected from damage ascribable to its contact with a developer carrier and from deterioration ascribable to water absorption and swelling. This extends the service life of the image carrier.

Various modifications will become possible for those skilled in the art after receiving the teachings of the present disclosure without departing from the scope thereof.

The invention claimed is:

1. An image forming apparatus, comprising:

an image carrier configured to carry a latent image thereon;

a developing roller including a roller portion and configured to be rotated while carrying developing liquid on the roller portion; and a voltage source configured to apply a voltage to a core of the developing roller forming an electric field between the roller portion and the image carrier, a voltage at the roller portion stabilized so as to correspond to the voltage applied to the core, wherein the developing liquid on the roller portion is transferred to the latent image formed on the image carrier.

2. The image forming apparatus of claim 1, wherein:

the roller portion has a volume resistivity ranging from 0 Ω·cm to $10^7$ Ω·cm.

3. The image forming apparatus of claim 1, wherein:

the roller portion and the image carrier are configured to make contact and form a nip, and the roller portion has a hardness of 30° or below in JIS-A scale or 60° or below in Asker-C scale.

4. The image forming apparatus of claim 1, wherein:

the roller portion has a ten-point mean surface roughness of 3 μm or less.

5. The image forming apparatus of claim 1, wherein:

the image carrier has a surface formed of a-Si.

6. A method for developing a latent image formed on an image carrier, comprising the steps of:

rotating an image carrier, the image carrier including a latent image;

rotating a developing roller including a roller portion, the roller portion carrying developing liquid;

applying a voltage to a core of the developing roller to form an electric field between the roller portion and the image carrier;

stabilizing the voltage at the roller portion to correspond to the voltage applied to the core; and transferring the developing liquid from the roller portion to the latent image formed on the image carrier.

7. The method of claim 6, further comprising the step of:

forming a nip between the roller portion and the image carrier.

8. The method of claim 6, wherein the step of applying a voltage further comprises:

forming the electric field at a nip formed between the roller portion and the image carrier.

9. The method of claim 6, wherein:

the roller portion has a hardness of 30° or below in JIS-A scale or 60° or below in Asker-C scale.

10. The method of claim 6, wherein:

the image carrier has a surface formed of a-Si.

11. An image forming apparatus comprising:

means for rotating an image carrier, the image carrier including a latent image;

means for rotating a developing roller including a roller portion, the roller portion carrying developing liquid;

means for applying a voltage to a core of the developing roller to form an electric field between the roller portion and the image carrier;

means for stabilizing the voltage at the roller portion to correspond to the voltage applied to the core; and means for transferring the developing liquid from the roller portion to the latent image formed on the image carrier.

* * * * *